United States Patent [19]

Bower, Jr.

[11] 3,967,673

[45] July 6, 1976

[54] CONTINUOUS-CASTING MOLD WITH MINIMAL THERMAL RESTRAINT AND METHOD OF MAKING

[75] Inventor: John E. Bower, Jr., Monroeville, Pa.

[73] Assignee: United States Steel Corporation, Pittsburgh, Pa.

[22] Filed: Dec. 11, 1974

[21] Appl. No.: 531,652

[52] U.S. Cl. ..... 164/82; 164/280

[51] Int. Cl.[2] ..... B22D 11/04

[58] Field of Search ..... 164/273 R, 280, 283 M, 164/82, 348, 73; 249/134, 135, 82

[56] References Cited

UNITED STATES PATENTS

| | | | |
|---|---|---|---|
| 2,428,658 | 10/1947 | Falk et al. | 249/82 |
| 3,709,286 | 1/1973 | Bower | 164/283 M |

FOREIGN PATENTS OR APPLICATIONS

| | | | |
|---|---|---|---|
| 1,903,157 | 8/1970 | Germany | 164/273 R |

OTHER PUBLICATIONS

Reinhold. *The Condensed Chemical Dictionary*, 1963, p. 919 and p. 1110.

*Primary Examiner*—Ronald J. Shore
*Assistant Examiner*—Gus T. Hampilos
*Attorney, Agent, or Firm*—Walter P. Wood

[57] ABSTRACT

A mold for continuously casting molten metal, which mold has a friction-reducing material disposed so that the surfaces of the copper liner and the steel backing plate of the mold bear against this material instead of directly against each other. Specifically, the friction-reducing material must possess a coefficient of friction significantly less than the coefficient of friction which results when copper bears against steel. Consequently, the restraint against thermal expansion is minimized, resulting in less distortion of the liner.

10 Claims, 4 Drawing Figures

EFFECT OF THE AMOUNT OF RESTRAINT ON MOLD DISTORTION

CONTINUOUS-CASTING MOLD WITH MINIMAL THERMAL RESTRAINT AND METHOD OF MAKING

BACKGROUND OF THE INVENTION

This invention relates to an improved mold for continuously casting metals and more particularly to a mold which has a friction-reducing material interposed between the copper liner and the steel backing plate to minimize thermal restraint.

A conventional continuous-casting mold is double-walled open-ended tube of various cross sections. The inner wall or liner of the mold usually is copper, but may be other materials which exhibit high thermal conductivity. The outer wall of the mold is usually steel which serves several distinct functions. First, it is the structural member which, because of its stiffness and strength, is primarily responsible for maintaining the liner in its original nondistorted shape. Secondly, it serves as a jacket for water that flows between it and the liner for cooling the liner and assisting in the solidification of the casting.

In conventional mold construction, the liner and the backing plate are secured together with studs or bolts which are connected to the liner and protrude through holes in the backing plate. The nuts or stud heads are tightened with a predetermined torque.

When molten metal is poured through the liner, the temperature of the liner increases much more than the temperature of backing plates. The liner tends to distort, bowing inwardly with respect to the backing plates. Subsequently, when the mold cools, the liner not only returns to its original configuration, but may actually bow outwardly if it had been heated to a sufficiently high temperature. These distortions in the liner produce relative movement between the liner and backing plates. If the liner is restrained against relative movement, permanent distortion and undesirable thermal stresses result.

It is, therefore, the primary object of my invention to provide an improved continuous-casting mold which has means for reducing the coefficient of friction significantly from the coefficient of friction which results from copper bearing against steel.

Another object of my invention is to provide a continuous-casting mold in which there is minimal restraint against thermal expansion of the liner.

Still another object of my invention is to provide a method and means for reducing the coefficient of friction by interposing between the backing plates and liner a friction-reducing material that may be applied by spraying, or in the form of sheets or tape.

These and various other objects and advantages of my invention will become apparent from the following detailed description when taken in conjunction with the attached drawings.

DESCRIPTION OF THE DRAWINGS

Figure 1:
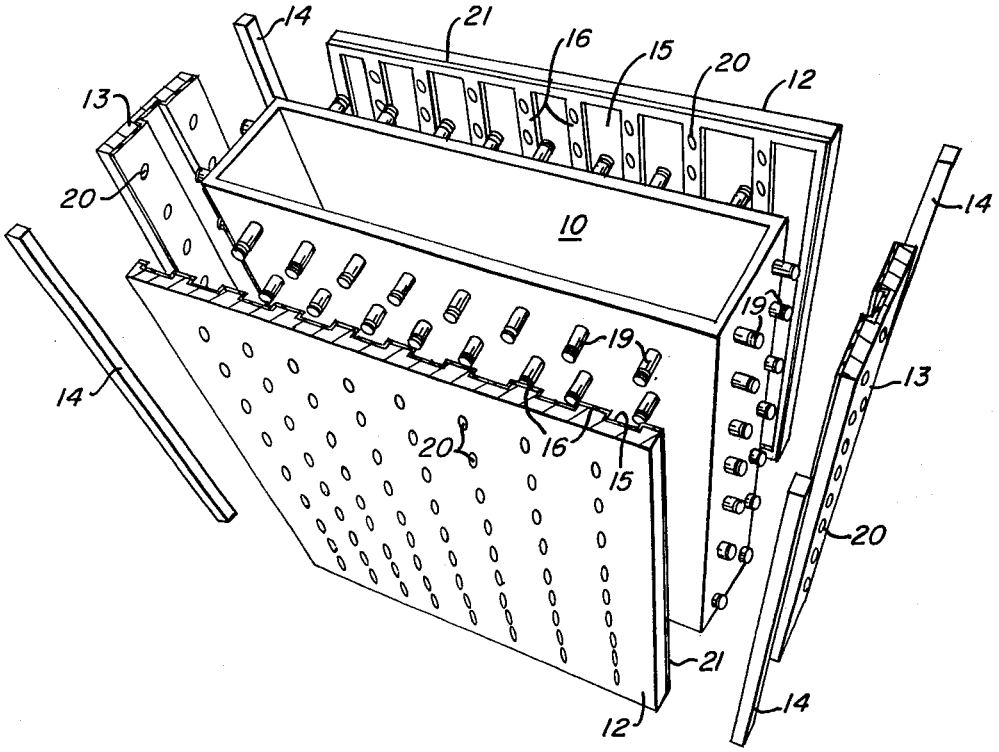
FIG. 1 is a simplified, exploded perspective view of one form of mold constructed in accordance with my invention.

FIG. 1 shows one form of a continuous-casting mold to which the present invention may be applied. The particular mold illustrated is similar to that shown in my earlier U.S. Pat. No. 3,709,286 and includes a copper inner wall or liner 10 and an outer wall or backing formed of steel side plates 12, end plates 13 and corner bars 14. The liner illustrated is of one-piece welded construction and has a relatively thin wall, preferably about ⅜ inch thick. A plurality of vertical channels 15 are machined in the inside faces of the side and end plates 12 and 13, respectively, leaving ribs 16 between channels 15. The channels 15 serve as passages for circulating water to cool the liner 10. The lower and upper ends of the channels have water inlets and outlets which are arranged in the usual fashion but are not shown since they are not involved in the present invention. A row of vertically spaced studs 19 are welded to the liner 10. The side and end plates 12 and 13 have openings 20 through their ribs 16 to receive the studs 19. Nuts are threadedly engaged with the ends of the studs outside the plates 12 and 13 to hold the parts assembled. The corner bars 14 are attached with threaded connectors (not shown) to afford handling and torsional rigidity to the assembled mold. A conventional mold assembled in this manner has static and dynamic coefficients of friction of at least 0.3 which oppose relative movement between the dissimilar metals of the liner 10 and the backing plates 12 and 13 when their surfaces are in direct contact. Nevertheless, it is apparent that the present invention is not limited to use with this particular mold.

In accordance with my invention, I insert a layer of friction-reducing material 21 having several specific attributes between the faces of the liner 10 and the backing plates 12 and 13, respectively. The friction-reducing material 21 lowers the coefficient of friction which opposes the relative movement between the liner 10 and the steel backing plates 12 and 13 to a maximum value of about 0.1. Thus, the liner 10 can move readily with respect to the backing plates 12 and 13 in response to differential thermal expansion and avoid permanent distortion caused by thermal stress of the liner 10. The surfaces of the liner 10 do not directly abut the surfaces of the backing plates 12 and 13. Specifically, the friction-reducing material 21 must possess a coefficient of friction significantly less than the coefficient of friction of a copper surface bearing against the steel surface. Also, the friction reducing material should not migrate under the action of the cooling water flowing between the liner 10 and the backing plates 12 and 13. Likewise, the friction-reducing material 21 should not interfere significantly with transfer of heat from the liner 10 to the cooling water. In addition, the friction-reducing material must not be worn away, squeezed away, or otherwise displaced from between the liner 10-backing plate 12 and 13 interface or deformed at the interface due to mold assembly, water flow, sliding action, or temperature changes. The friction-reducing material 21 should also be economical and should be able to be applied easily and quickly.

Tests on several candidate materials and actual experience in continuous-casting molds have indicated that plastic coatings of a type known generally as Teflon—applied either as bolted-on sheets, sprayed-on dispersions, or adhesively bonded tape—meet the above requirements. Other coatings including graphite and/or molybdenum disulfide dispersions, also meet the requirements but are less satisfactory.

In assembling a mold, therefore, the backing plates are preferably coated on the cooling-water side with the friction-reducing material 21, such that when the liner 10 is attached to the backing plates, the liner 10 contacts the friction-reducing material 21. The friction-reducing material 21, having a coefficient of friction of about 0.10 and less, then offers negligible restraint to the repeated thermal expansion and contraction of the liner 10 that occurs during continuous-casting service.

Figure 3:
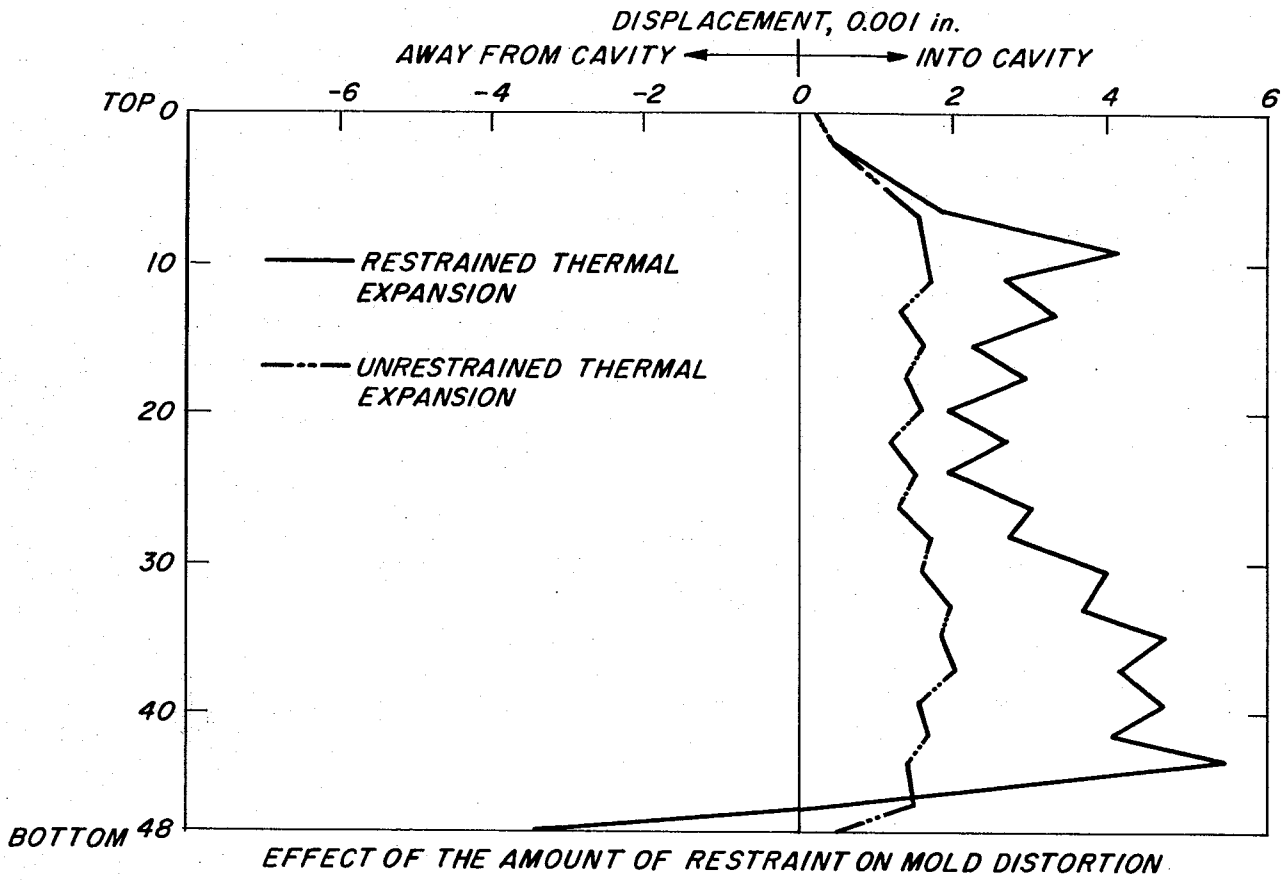
FIG. 3 is an exaggerated graph showing calculated distortions of a vertical section of a mold where thermal expansion is restrained (solid line) and also unrestrained (broken line)
Figure 4:
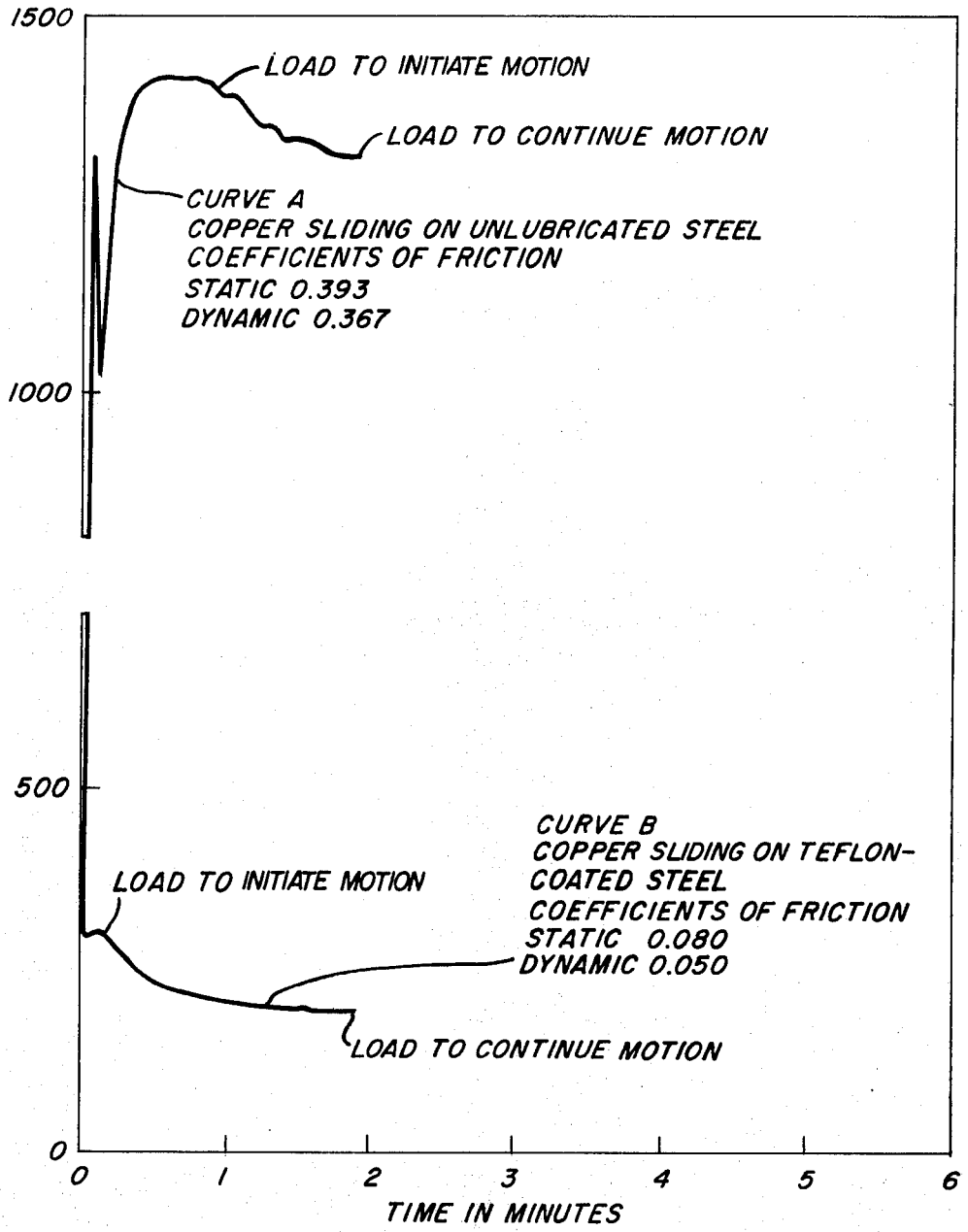
FIG. 4 is a graph comparing the coefficient of friction for copper sliding directly on steel and copper sliding on the friction-reducing material of my invention.

The solid line in FIG. 3 shows the calculated distortions (shown to an exaggerated scale for facility of depiction) of a vertical section of a typical mold design when thermal expansion is restrained. FIG. 3 also shows, with the broken line, the calculated distortions (shown to an exaggerated scale for facility of depiction) for the same section when thermal expansion is unrestrained, as when a friction-reducing material is used in accordance with this invention. The distortions in FIG. 3 are the out-of-plane distortions or distortions of the copper liner into the mold cavity. FIG. 4 shows the results of tests conducted to determine the resistance to sliding that occurs between cooper and steel curve A without an intermediate friction-reducing material, and curve B when a sprayed-on-Teflon coating is used. In both cases, force clamping the copper and steel equals the force used in assembling the mold.

It can be seen, when comparing the relative distortion-free liner represented by the broken line of FIG. 3 and the curve B of FIG. 4, the advantages to be gained from the friction-reducing material 21, with the profile of the liner 10 represented by the solid line in FIG. 3 and the curve A of FIG. 4. The average displacement of the liner without the friction-reducing material is about twice that of the liner with the friction-reducing material; moreover, the localized displacement between studs when there is no friction-reducing material is about five to six times greater than when there is a friction-reducing material.

Figure 2:
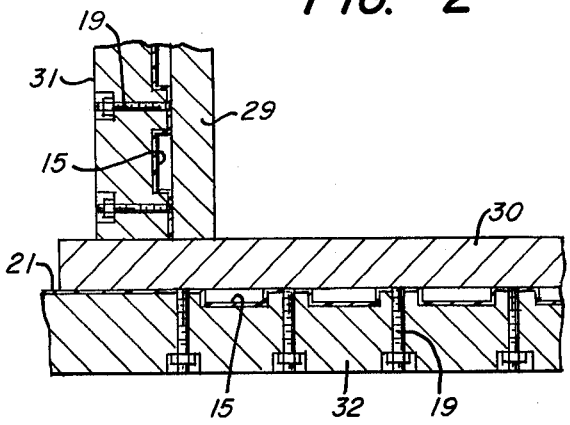
FIG. 2 is a horizontal section through the double wall of a modified mold to which my invention has been applied.

FIG. 2 shows a modification in which I apply the principles of my invention to a fourpiece liner 10. The liner 10 includes end members 29 which abut the interfaces of side members 30. I interpose friction-reducing material 21 between end members 29 and backing member 31 and side members 30 and backing members 32. This construction enables the liner to be adjusted to cast different size product, as known in the art.

I am aware of Canadian Pat. No. 938,425 which shows the means for preventing corrosion caused by voltaic action by the liner and backing plates of a continuous-casting mold. The patentee places a layer of foil or other material which substantially prevents the voltaic or electrolytic cell with copper and water as the electrolyte from forming between the liner and the backing plates. He does not suggest, however, that such a layer in any way reduces the coefficient of friction.

I claim:

1. In a continuous-casting mold which includes:

a. an open-ended liner of a metal of high heat conductivity;

b. backing plates including side and end plates of a different metal providing mechanical strength;

c. means including rows of vertically spaced studs secured to said liner with vertically spaced matching openings in said backing plates for securing backing plates to said liner;

d. means including a plurality of channels on the inside faces of said side and end plates providing water circulation passages between said backing plates and said liner;

e. the static and dynamic coefficients of fricton opposing relative movement between the metals of said liner and said backing plates when their surfaces are in direct contact being at least 0.3; and f. the improvement comprising means interposed between the surfaces of said liner and said backing plates to lower the coefficient of friction opposing relative movement to a maximum value of about 0.1, whereby the liner can move readily with respect to said backing plates in response to differential thermal expansion and avoid permanent distortion and thermal stresses in said liner.

2. A continuous casting mold according to claim 1 wherein said means interposed between the surfaces of said liner and said backing plates is Teflon.

3. A continuous-casting mold according to claim 1 wherein said means interposed between the surfaces of said liner and said backing plates is applied to said backing plates by spraying.

4. A continuous casting mold according to claim 1 wherein said means interposed between the surfaces of said liner and said backing plates is applied to said backing plates in the form of a sheet.

5. A continuous-casting mold according to claim 1 wherein said means interposed between the surfaces of said liner and said backing plates is applied to said backing plates in the form of a tape adhesively bonded to said backing plate.

6. A method of minimizing the thermal restraint in a continuous-casting mold having an open-ended liner of a metal of high heat conductivity, backing plates including side and end plates of a different metal for providing mechanical strength secured to said liner by means of rows of vertically spaced studs secured to said liner with vertically spaced matching openings in said backing plates and means including a plurality of channels on the inside faces of said side and end plates for circulating fluid between said backing plates and said liner, the static and dynamic coefficients of friction opposing relative movement between metals of said liner and said backing plates when their surfaces are in direct contact being at least 0.3; said method comprising the step of:

applying a coating selected from the group consisting of Teflon, graphite and molybdenum disulfide to one of said liner and said backing plate to lower the coefficient of friction opposing relative movement to a maximum value of about 0.1, whereby the liner can move readily with respect to said backing plates in response to differential thermal expansion to minimize the restraint of said thermal expansion and thereby minimizing permanent distortions and thermal stresses in said liner.

7. A method according to claim 6 wherein said coating is Teflon.

8. A method according to claim 6 wherein said coating is applied to said backing plates by spraying.

9. A method according to claim 6 wherein said coating is applied to said backing plates in the form of a sheet.

10. A method according to claim 6 wherein said coating is applied to said backing plates in the form of a tape adhesively bonded to said backing plates.

* * * * *